United States Patent [19]

Rohde et al.

[11] Patent Number: 4,546,930

[45] Date of Patent: Oct. 15, 1985

[54] CONTINUOUS WEB WINDER

[75] Inventors: Günter Rohde, Zang; Dieter Holzinger, Herbrechtingen; Udo Grossmann, Heidenheim, all of Fed. Rep. of Germany

[73] Assignee: J. M. Voith GmbH, Heidenheim, Fed. Rep. of Germany

[21] Appl. No.: 618,194

[22] Filed: Jun. 7, 1984

[30] Foreign Application Priority Data

Jun. 11, 1983 [DE] Fed. Rep. of Germany ..... 3321213

[51] Int. Cl.[4] ..... B65H 19/26; B65H 19/28

[52] U.S. Cl. ..... 242/56 R; 242/56.6; 242/65

[58] Field of Search ..... 242/56 R, 56 A, 56.6, 242/65, 56.5

[56] References Cited

U.S. PATENT DOCUMENTS

| | | | |
|---|---|---|---|
| 2,528,713 | 11/1950 | Thomson | 242/65 |
| 2,585,227 | 2/1952 | Christman | 242/56.6 |
| 2,698,662 | 1/1955 | Moody | 164/73 |
| 2,915,255 | 12/1959 | Phelps | 242/56 R |
| 2,920,836 | 1/1960 | De Bell | 242/65 |
| 3,191,883 | 6/1965 | Wells | 242/56 R |
| 3,743,199 | 7/1973 | Karr et al. | 242/65 |
| 3,794,256 | 2/1974 | Schwarz | 242/56 A |
| 4,146,187 | 3/1979 | Steiner et al. | 242/56 R |
| 4,445,646 | 5/1984 | Karr et al. | 242/56 R |
| 4,458,852 | 7/1984 | Calvert | 242/56 A |

FOREIGN PATENT DOCUMENTS

| | | |
|---|---|---|
| 296062 | 10/1914 | Fed. Rep. of Germany . |
| 1561718 | 4/1970 | Fed. Rep. of Germany . |

*Primary Examiner*—John M. Jillions

*Attorney, Agent, or Firm*—Albert L. Jeffers; Stephen T. Belsheim

[57] ABSTRACT

An apparatus for winding a continuous web, specifically tear-resistant paper or cardboard web, is preferably designed as a Pope reel winder, and when exchanging a full roll with an empty reel-spool, the latter is in customary fashion placed on the winding drum over which the web initially continues to advance onto the full roll. At the edge of the web, a sickle-shaped catch lever reaches around the upper portion of the empty reel-spool and engages the edge of a web loop to pull it about a portion of the empty reel-spool. Simultaneously, a cutting device can make a transverse cut in the edge of the paper web, and once the web edge has been engaged by the empty reel-spool, the remaining portion of the web tears through essentially without any shock effect.

17 Claims, 5 Drawing Figures

Fig.1
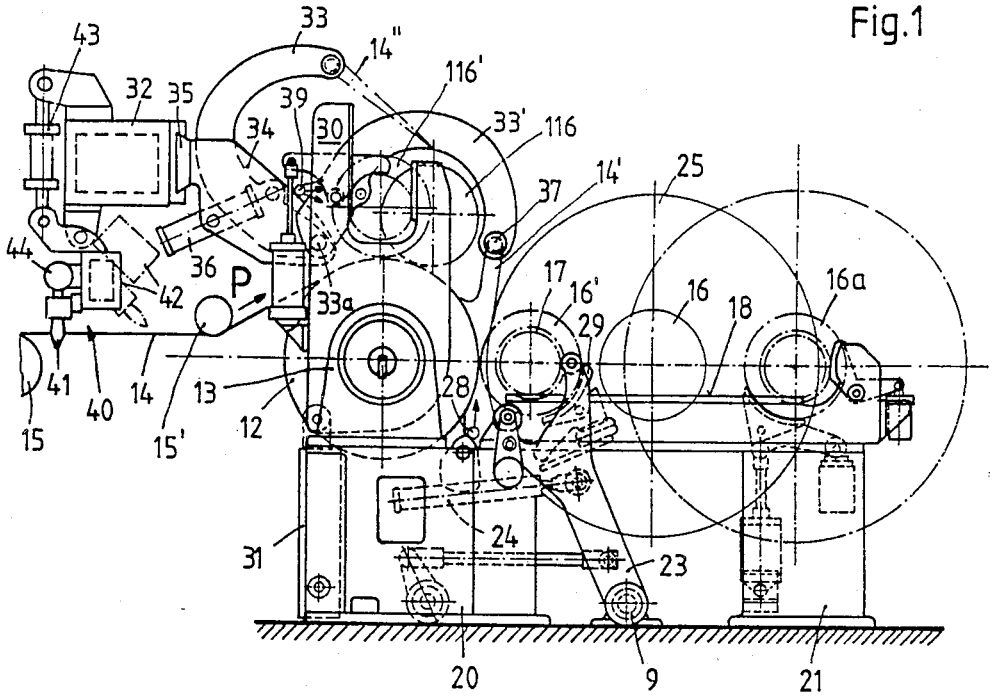
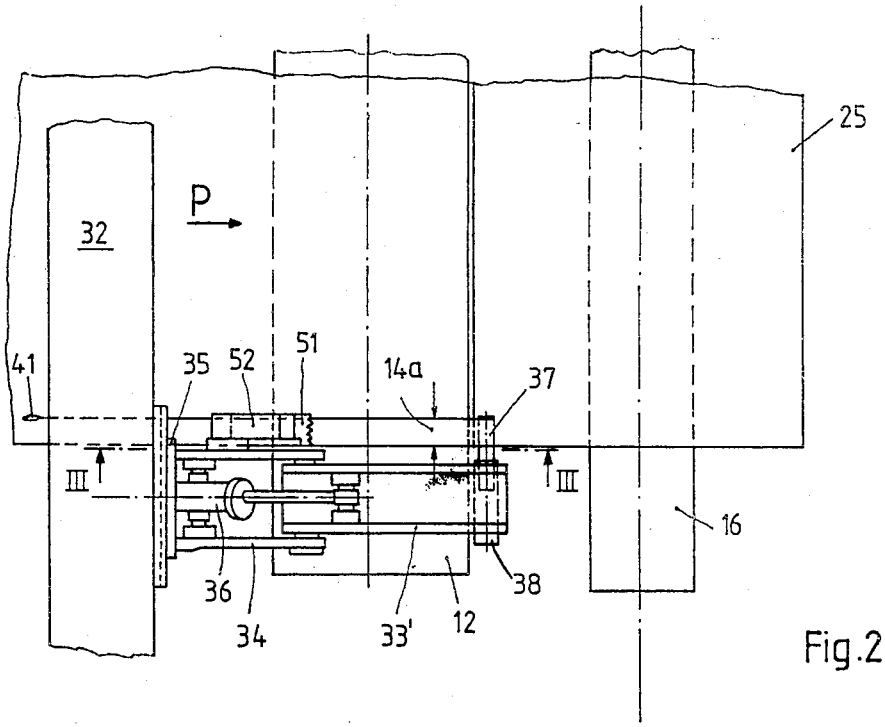
Fig.2

CONTINUOUS WEB WINDER

The present invention comprises an apparatus for exchanging a full roll with an empty reel-spool, wherein the apparatus supports the empty reel-spool in a ready position near the web being wound on the full roll; a brake for slowing the rotation of the full roll; and a blower device arranged substantially between the empty reel-spool and full roll for forming a portion of the web into a loop. A more detailed description of this portion of the present invention is disclosed in German Pat. No. 20 10 072.

Various apparatuses and methods exist for exchanging full rolls with empty reel-spools. In one such apparatus utilizing a Pope reel winder, the web is lifted off the winding drum, for example, by means of compressed air, and is torn and transferred in spiral fashion onto the new, empty reel-spool. This apparatus and method is suitable for relatively thin webs, but the slitting of the web is somewhat more difficult when a heavier material web is involved, such as cardboard. Slitting of these heavier materials, such as cardboard, is effected by use of a tear line. The tear line may be attached with one end on one of the end faces of the empty reel-spool and stretched in the entering area of the winding drum underneath the cardboard web and across the machine. As the empty reel-spool begins to rotate, the tear line begins to wind onto the empty reel-spool in a spiral fashion, thereby severing the cardboard web and transferring it onto the empty reel-spool. This method is suitable for low web speeds, but a disadvantage thereto is a resulting high scrap rate.

On Pope-reel winders for heavy and tear-resistant paper grades, for instance kraft paper, liner and similar materials, the full roll is first moved away from the winding drum and thereafter the web proceeding from the winding drum to the full roll is blown from below into an upwardly disposed loop by means of compressed air jets. The empty reel-spool then engages the web, which bursts or rips creating an enormous shock that can be harmful to various machine components, particularly on wide paper machines. Another disadvantage with this apparatus and method is that the engagement of the loop by the empty reel-spool can be delayed, thereby resulting in an undesirably high scrap rate because of the outermost layers on the finished roll being loosened due to the temporary lack of web tension.

The above referenced German Pat. No. 20 10 072 discloses other separating devices suited for tear-resistant webs and other webs difficult to cut. These separating devices generally include severing elements, such as wire, heated rods, blades and the like, which transversely extend across the advancing web throughout the entire device. The severing device is generally attached to two pivotal levers, whose pivot axes are disposed near the axis of rotation of the winding drum, and the severing element or elements thereof are receivable from below into a space between the winding drum and full roll.

The above described apparatus is preferably used for reeling relatively narrow webs, and is generally unsuited for paper or cardboard apparatuses or webs having a large width, since the severing device would need to be constructed as a heavy blade beam.

One object of the present invention is to provide an improved continuous web winder for winding continuous webs, such as paper, cardboard and like materials, that virtually eliminates the above-described shocks and undesirably high scrap rates occurring during reel exchanges and the cutting or separating of tear-resistant webs.

Another object of the present invention is to provide an improved continuous web winder for winding continuous webs having different widths, and particularly wide webs in the range of about six to about ten meters.

The improved continuous web winder of the present invention comprises a sickle-shaped catch lever disposed near the web and having one end portion thereof pivotally mounted on the web entrance side of the empty reel-spool at its ready position. The catch lever is pivotal between a rest position wherein the lever is spaced-apart from the empty reel-spool and a catch position wherein the lever is peripherally disposed about an area of the empty reel-spool as yet uncovered by the advancing web. The catch lever has on its opposite end portion a catch means for engaging the web loop when the catch lever is at the catch position. The catch lever then disposes the web about a portion of the circumference of the empty reel-spool when pivoting from the catch position to the rest position.

Thus, the present invention provides a catch lever which engages an edge of the web, which has been formed into a loop between the empty reel-spool and the full roll, and disposes the loop around part of the circumference of the empty reel-spool in the direction toward the web run-on side of the reel-spool.

Further, the present invention also provides a pair of catch levers disposed on opposite sides of the web loop for engaging the edges thereof to place the loop on the empty reel-spool.

One of the unique features of the present invention is that the catch lever or levers provide a tensioning along the web edges during the entire exchange process. This is particularly advantageous in two respects; the first being that the web remains tightly wound on the full roll due to the tension applied thereto, thereby reducing the possibility that outer layers of the web will be loosened during the separation thereof. Secondly, the edge area of the web, which has been pulled around the empty reel-spool by the catch lever, will upon being released by the catch device be more quickly caught or engaged by the empty reel-spool than the remaining portion of the web, thereby resulting in a controlled tearing or separating of the web beginning in the edge area. This essentially eliminates a sudden bursting or ripping action across the entire width of the web, thereby eliminating undesirable shocks on the apparatus.

The continuous web winder of the present invention is particularly suited for heavy and tear-resistant paper and cardboard webs, and also particularly suitable for relatively high operating speeds.

Another unique feature of the present invention is the provision of a cutting device with the catch lever, so that during the return swing of the catch lever to its rest position, and as the web loop is placed around the empty reel-spool, the cutting device splits the web transversely, thereby eliminating the initial bursting or ribbing of the web in the edge area and the associated shock on the other elements of the apparatus.

Another advantage associated with the cutting device is that considerably less force is required when carrying the web as a continuation of the initial cut. Moreover, this generally avoids a doubling-up of the web during its initial advance about the new empty reel-spool.

Yet, another unique feature of the present invention is the provision of the strip cutter being disposed on the side of the winder toward which the web advances. The strip cutter, which can be a linear cutter, severs a relatively narrow transverse strip from the advancing web at the web edge near the catch lever. Thus, the catch lever is required only to place the cut transfer strip about the empty reel-spool. As the empty reel-spool begins to engage and wind the transfer strip, the strip cutter is transversely moved across the web for the severing thereof. Naturally, only a very weak shock effect is created on cutting the narrow transverse strip. This particular feature is especially advantageous with the present invention when using very wide paper machines.

If desired, the continuous web winder of the present invention can utilize both the cutting devices and the strip cutter, thereby avoiding any doubling-up of the web transfer strip on the empty reel-spool.

In order to achieve a uniform roll, it is desirable that the length of the transfer strip be as small as possible, and this can be effected by simultaneously transversely cutting the advancing web as the empty reel-spool seizes or engages the transfer strip. This permits the normal winding operation to expeditiously begin.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein:

FIG. 1 is a side elevational view of a preferred embodiment of the present invention;

FIG. 2 is a partial plan view of the embodiment in Fig. 1;

DESCRIPTION OF A PREFERRED EMBODIMENT

Figure 3:
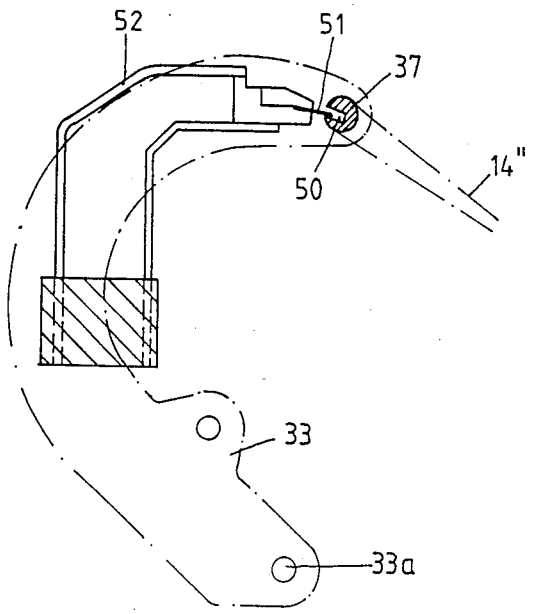
FIG. 3 is a sectional view taken along lines III—III in FIG. 2 and viewed in the direction of the arrows.

Referring primarily to FIGS. 1 and 2, the present invention illustrates a winding drum 12 mounted on both its sides in support bearings 13 and powered by drive elements (not shown). Web 14 is wound on reel-spool 16' in the direction of arrow P by guide rolls 15 and 15' and over winding drum 12. Bearing bushings 17 of reel-spool 16' rest on both sides on horizontal tracks 18. Support bearings 13 and tracks 18 are mounted on supports 20,21, and mounted below tracks 18 in two pillow blocks 9 are a pair of forked transfer levers 23, which are actuated by cylinder 24. During winding, transfer levers 23 act on bearing bushings 17 to force reel-spool 16', along with the web roll being formed thereon, against winding drum 12. In the position of transfer levers 23 illustrated in FIG. 1, a winding operation on reel-spool 16' has just begun. A full reel-spool **16*a* has previously been moved with the aid of levers 23 to the end of tracks 18 for removal. At 16 is the position assumed by a full reel-spool at the start of a reel change. It can be seen that the finished roll 25 wound on the reel-spool 16 has already been moved away from winding drum 12**.

Provided on the two end sides of winding drum 12 are two forked advancing levers 30, which are operated by actuating cylinders 31. Advancing levers 30 are mounted on support bearings 13 such that they are pivotal on an axis eccentrically disposed relative to the winding drum axis and horizontally spaced thereapart against the direction of web travel. While web 14 is being wound on reel-spool 16', advancing levers 30 extend vertically upwardly holding empty reel-spool 116' in reserve. At 116 is the position of an empty reel-spool in the ready position, which rotates at a speed approximately that of web travel. This ready position is assumed at the start of the reel change by appropriate pivoting of advancing levers 30. In the process, empty reel-spool 116 contacts web 14 advancing over winding drum 12 and is rotated through peripheral friction or by a starting device (not shown). Brake 29 is provided on transfer levers 23 for slowing the rotation of finished roll 25.

Extending above the portion of web 14 advancing toward winding drum 12 is rigid crossbeam 32, on which can be disposed strip cutter 40. Crossbeam 32 rests with both ends thereof on supports (not shown). Strip cutter 40 comprises blade 41, which may be a rotating blade, for performing two different cutting movements. Blade 41 bears indirectly on crossbeam 42 which is pivotally mounted on rigid crossbeam 32, and pivoting movement is provided by cylinder 43. Illustrated in dash-dot lines is the position of blade 41 and crossbeam 42 when blade 41 is located in its inoperative position outside web 14. The solid lines in FIG. 1 indicate blade 41 and crossbeam 42 in their operating position, in which blade 41 makes a cut in web 14. With reference to FIG. 2, blade 41 separates from advancing web 14 a narrow transfer strip **14*a*. Illustrated schematically in FIG. 1 is transport device 44 which moves blade 41 transversely across advancing web 14** for the severance thereof at the appropriate time.

Below the gap formed between winding drum 12 and finished roll 25 is blow tube 28 transversely extending across web 14. In conjunction with the simultaneous slowing or braking of finished roll 25, web 14 can be formed into a loop 14' above the gap by means of air discharging from blow tube 28.

To the side of web 14 is sickle-shaped catch lever 33 pivotally mounted on support arm 34, which is attached to rigid crossbeam 32. If desired, support arm 34 may be transversely adjusted across the width of web 14 by means of dovetail guide 35. Pivot **33*a* of catch lever 33 is located in the area of the web entrance side of empty reel-spool 116, and closely spaced near the circumference of winding drum 12. Catch lever 33 is so shaped that it can reach around the upper peripheral part of reel-spool 116 which is not in contact with web 14 when reel-spool 116 is at the ready position. This position of catch lever 33 as it reaches around the upper peripheral part of reel-spool 116 is termed the catch position, which is marked 33' in FIG. 1; the position of the catch lever at 33 represents the rest position Cylinder 36 serves to slue catch lever 33**.

Catch lever 33 has on its outermost end a catch device for engaging the transfer strip **14*a* formed into loop 14'. Referring to FIG. 2, the catch device comprises bolt 37, which is introduced into the formed loop 14' transversely to the direction of web travel by means of pneumatic cylinder 38. If desired a tong-type device may be utilized in place of bolt 37. The engagement of loop 14' occurs in the catch position of catch lever 33'. Thereafter, catch lever 33' is moved to its rest position, indicated as catch lever 33, thereby stretching loop 14" around a portion of the circumference of empty reel-spool 116. Bolt 37 is retracted at the same time so that loop 14" drops into the gap between winding drum 12 and reel-spool 116 to be engaged thereby. It is important at this point that good adhesion exist between web loop 14" and reel-spool 116, and this adhesion can be provided by wetting reel-spool 116 with a liquid, such as water. Liquid spray tube 39 is disposed on catch arm 33 for wetting reel-spool 116**.

While reel-spool 116 engages and begins to wind transfer strip 14*a*, blade 41 is transversely passed across web 14 to separate it as described above. It should be noted that with narrow paper machines, strip cutter 40 and transfer strip 14*a* may be dispensed with, and instead the web loop 14' can be engaged as the whole web 14 at one of its edges by bolt 37 and passed around empty reel-spool 116 in the described manner.

When using strip cutter 40, spray tube 39 needs only to be provided in the area of transfer strip 14*a*, and a single spray nozzle may be sufficient. Further, it can be sufficient to direct blow tube 28 only at transfer strip 14*a* so that the remaining portion of web 14 forms a loop below the gap between winding drum 12 and roll 25. Alternatively, the remaining portion of web 14 may be blown upwardly as well to be formed as a loop during reel change Referring to FIGS. 2 and 3, bolt 37 of catch lever 33 has, in its side over which web loop 14' wraps, a groove 50, which when catch lever 33 is in the rest position, is engaged by fixed blade 51. This permits cutting of transfer strip 14a, or when cutter 40 is not utilized, permits a cut to be made in the edge of web 14 so that web 14 may be transversely separated. Blade 51 is attached to holder 52 mounted on support arm 34.

Figure 4:
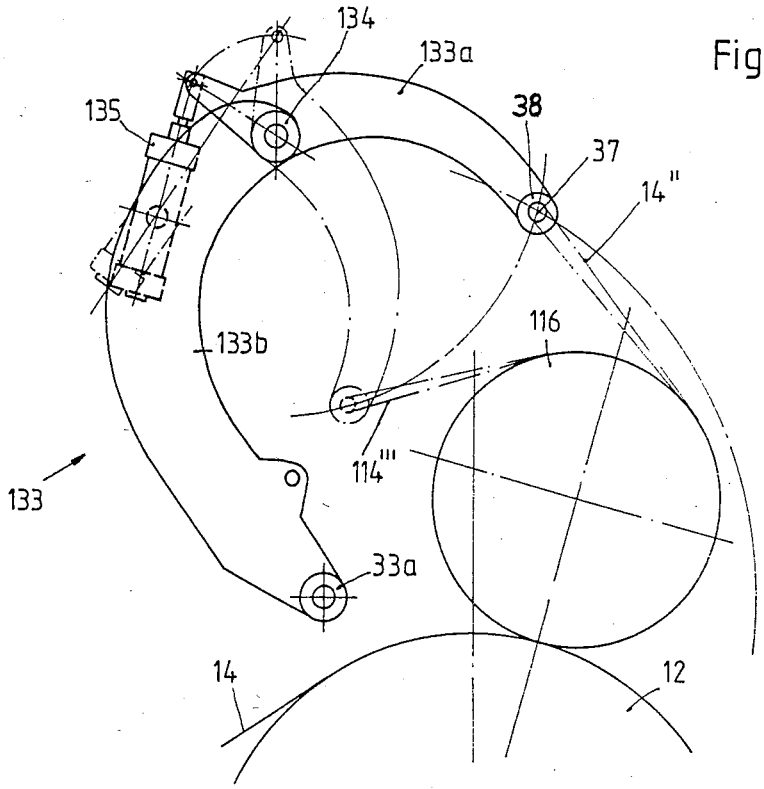
FIG. 4 is a side elevational view of another embodiment of the catch lever in FIG. 3.

It may be that with certain paper grades, the wraparound produced by one-piece catch lever 33 about empty reel-spool 116 may not be sufficient to ensure reliable engagement of web loop 14" by reel-spool 116. A two-piece catch lever 133 (FIG. 4) may be used, wherein the remote end portion 133*a* supports bolt 37 and cylinder 38 and is pivotally attached by means of bearing 134 to the main portion 133*b* of catch lever 133. Actuating cylinder 135 is operatively connected between main portion 133*b* and remote end portion 133*a*, and upon operating cylinder 135 the remote end portion 133*a* swings inwardly and bolt 37 and cylinder 38 move toward pivot bearing 33*a* of catch lever 133. As illustrated in FIG. 4, the wraparound of loop 14''' about reel-spool 116 is considerably increased.

Figure 5:
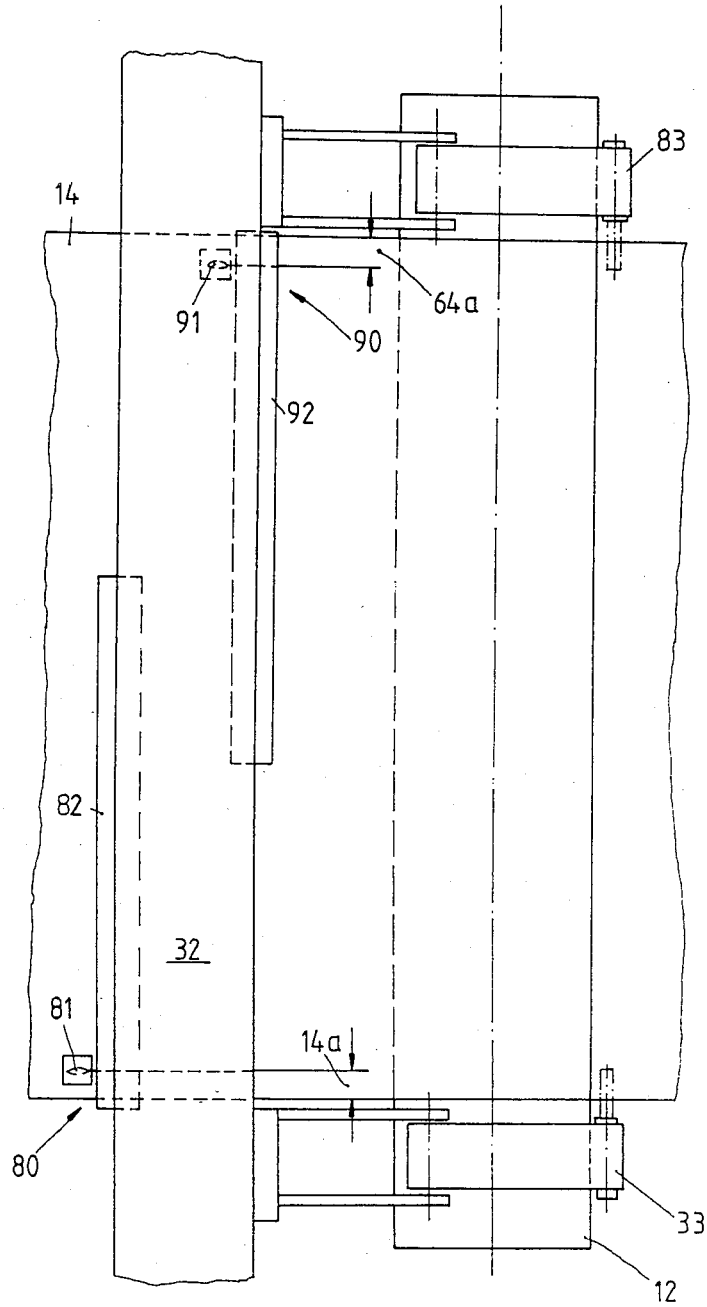
FIG. 5 is a partial plan view of another embodiment of the present invention.

Referring to FIG. 5, there is schematically illustrated another embodiment of the present invention including on both edges of web 14 catch levers 33,83. This permits simultaneous engagement of paper web 14 at its edges so as to place it around reel-spool 116. If desired, transfer strips 14*a*, 64*a* can be cut on both edges of web 14. Strip cutters 80,90, which provide transfer strips 14*a*, 64*a*, are offset from each other in the direction of web travel. The length of crossbeams 82,92 are each somewhat greater than one-half the width of web 14, so that crossbeams 82,92 overlap in spaced-apart relation. Therefore, cuts transversely made across web 14 by blades 81,91 will overlap in a similar manner. The advantage with the embodiment illustrated in FIG. 5 is that the start of the roll will not become single-sided conical, but rather symmetrically double-conical, and facilitates the transfer of paper web 14 from full roll 16 to empty reel-spool 116. Further, the first transfer of web 14 after a prolonged machine downtime can be performed in the same manner, and should a full roll 25 not be available, an empty reel-spool may take its place.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. An apparatus for winding a continuous web, such as paper, cardboard and the like, on reel-spools including means for exchanging a full roll with an empty reel-spool rotating at a speed approximately the same as the speed of web travel, said exchanging means supporting the empty reel-spool in a ready position near the web being wound on the full roll; a brake for slowing the rotation of the full roll; and a blower device arranged substantially between the empty reel-spool and the full roll for forming a portion of the web into a loop; characterized in that:

a sickle-shaped catch lever is disposed near the web and has one end portion thereof pivotally mounted on the web entrance side of the empty reel-spool at the ready position, said sickle-shaped catch lever being pivotal between a rest position wherein said sickle-shaped catch lever is spacedapart from the empty reel-spool and a catch position wherein said sickle-shaped catch lever is peripherally disposed about a portion of the empty reel-spool as yet uncovered by the advancing web, said sickle-shaped catch lever having on its opposite end portion a catch means for engaging the web loop when said catch lever is at the catch position, said catch lever disposing the web around a portion of the circumference of the empty reel-spool when pivoting from the catch position to the rest position.

2. The apparatus of claim 1 further comprising liquid spraying means disposed adjacent said catch lever and adapted for spraying a liquid on the empty reel-spool to assist in adhering the web to the empty reel-spool.

3. The apparatus of claim 2 wherein said liquid spraying means is operative when said catch lever pivots from the catch position to the rest position.

4. The apparatus of claim 1 wherein said catch lever is adjacent an edge of the advancing web, and wherein said catch means includes a bolt member transversely extendable and retractable relative to the web and being engageable with the web loop when extended.

5. The apparatus of claim 4 further comprising a cutting device for transversely cutting an edge portion of the web loop when said catch lever is at the rest position.

6. The apparatus of claim 5 wherein said cutting device includes a blade member for cutting the web, and wherein said bolt member has a groove therein for receiving said blade member.

7. The apparatus of claim 6 wherein said blade member is stationary and receivable in said bolt member groove when said catch lever pivots to the rest position.

8. The apparatus of claim 6 wherein said cutting device is attached to said catch lever and pivotal therewith.

9. The apparatus of claim 1 further comprising a strip cutter disposed on the side of the empty reel-spool toward which the web advances, said strip cutter being movable towards the edge of the web to cut a transfer strip portion therefrom engageable by the empty reel-spool, said strip cutter further being transversely moveable across the web for the cutting thereof.

10. The apparatus of claim 1 wherein said catch lever is transversely movable parallel to the axes of the reel-spools so as to be adjustable to webs of varying widths.

11. The apparatus of claim 1 wherein said opposite end portion of said catch lever is pivotally connected to said one end portion, said catch means being pivotal toward the pivot axis of said catch lever at the rest position.

12. The apparatus of claim 1 wherein said catch lever is disposed on one edge side of the web, and further comprising a second said catch lever being disposed on the other edge side of the web.

13. The apparatus of claim 12 further comprising a pair of cooperating strip cutters disposed on the side of the empty reel-spool toward which the web advances, said strip cutters being further disposed on opposite sides of the web in an offset manner relative to the direction of web advancement, said strip cutters being movable towards respective edges of the web for cutting respective transfer strips therefrom engageable by the empty reel-spool, said strip cutters further being transversely moveable across the web for making transversely overlapping cuts therein.

14. In an apparatus for winding a continuous web, such as paper, cardboard and the like, on reel-spools including a device for exchanging a full roll with an empty reel-spool rotating at approximately the same speed as web travel, the device supporting the empty reel-spool in a ready position near the web being wound on the full roll; a brake for slowing the rotation of the full roll; and a blower arranged substantially between the empty reel-spool and full roll for forming a portion of the web into a loop; a method for changing the web from the full roll to the empty reel-spool, comprising the steps of:

providing a sickle-shaped catch lever disposed near the web and having one end portion pivotally mounted on the web entrance side of the empty reel-spool at the ready position, the catch lever being pivotal between a rest position wherein the catch lever is spaced-apart from the empty reel-spool and a catch position wherein the catch lever is peripherally disposed about a portion of the empty reel-spool as yet uncovered by the advancing web, the catch lever having on its opposite end portion a catch device for engaging the web loop when the catch lever is at the catch position, pivoting the catch lever from the rest position to the catch position, then reducing the rotation of the full roll by activating the brake thereagainst, thereafter forming a loop in the web by activating the blower device, engaging the web loop with the catch member, then pivoting the catch lever back to the rest position to engage the web loop with a portion of the circumference of the empty reel-spool, and disengaging the catch member from the web loop.

15. The method of claim 14 further comprising the steps of providing a liquid sprayer adjacent the catch lever and directed toward the empty reel-spool, and during the pivoting of the catch lever to the rest position and during the disengaging of the catch member, wetting the empty reel-spool by activating the liquid sprayer.

16. The method of claim 14 further comprising the steps of providing a winding drum having the web advancing around a surface portion thereof and against which the wound web on the full roll is disposed, moving the full roll away from the winding drum while reducing the rotation of the full roll to form a gap between the winding drum and full roll through which the blower acts on the web.

17. The method of claim 14 further comprising the steps of:

providing a movable strip cutter disposed on the side of the empty reel-spool toward which the web advances;

at the beginning of pivoting the catch lever from the rest position, severing a transfer strip from an edge of the web by moving the strip cutter into engagement with the web, and after the web loop has engaged the empty reel-spool, transversely severing the web by moving the strip cutter transversely thereacross.

* * * * *